US005624506A

United States Patent [19]

Tsuzaki et al.

[11] Patent Number: 5,624,506

[45] Date of Patent: Apr. 29, 1997

[54] COPPER ALLOY FOR USE IN ELECTRICAL AND ELECTRONIC PARTS

[75] Inventors: Yoshinobu Tsuzaki, Hatano; Tetsuo Kato, Shizuoka-ken; Yukio Ohota, Shizuoka-ken; Naoki Kakuta, Shizuoka-ken, all of Japan

[73] Assignees: Kabushiki Kaisha Kobe Seiko Sho, Kobe; Yazaki Corporation, Tokyo, both of Japan

[21] Appl. No.: 424,524

[22] PCT Filed: Sep. 30, 1994

[86] PCT No.: PCT/JP94/01636

§ 371 Date: Aug. 9, 1995

§ 102(e) Date: Aug. 9, 1995

[87] PCT Pub. No.: WO95/09252

PCT Pub. Date: Apr. 6, 1995

[30] Foreign Application Priority Data

Sep. 30, 1993 [JP] Japan ..... 5-245470

[51] Int. Cl.[6] ..... C22C 9/00

[52] U.S. Cl. ..... 148/433; 420/472; 420/473

[58] Field of Search ..... 148/433; 420/472, 420/473

[56] References Cited

FOREIGN PATENT DOCUMENTS 58-218701 12/1983 Japan .

63-266053 11/1988 Japan .

02-111833 4/1990 Japan .

02-145737 6/1990 Japan .

03-31437 2/1991 Japan .

03-285053 12/1991 Japan .

*Primary Examiner*—Sikyin IP

*Attorney, Agent, or Firm*—Oblon, Spivak, McClelland, Maier & Neustadt, P.C.

[57] ABSTRACT

A copper alloy for use in an electrical and electronic parts contains Fe of 1.8–2.0 weight %, P of 0.025–0.040 weight %, Zn of 1.7–1.9 weight %, Sn of 0.40–1.0 weight %, and Ca of 0.0001–0.01 weight %, the balance being Cu and inevitable impurities. Further the copper alloy may contain one kind or two kinds of the elements selected from the group of Cr of 0.001–0.01 weight % and Mg of 0.001–0.01 weight %, by 0.001–0.01 weight % at a total amount. This copper alloy for use in electrical and electronic parts can dissolve the prior problem that cracking is apt to occur on the ingot during heating on the hot working process or during hot working, and can prevent a short-circuit due to the migration phenomenon of copper which is apt to occur with the high density integration of the electrical and electronic parts made of copper alloy, and further can improve the tool service life (wear resistance) of the die and can decrease the producing cost thereof.

2 Claims, 3 Drawing Sheets

COPPER ALLOY FOR USE IN ELECTRICAL AND ELECTRONIC PARTS

INDUSTRIALLY APPLICABLE FIELD

The present invention relates to a copper alloy for use in electrical and electronic parts such as terminals and connectors and the like.

BACKGROUND OF THE TECHNIQUE

Conventionally, an iron-contained copper alloy (Cu-Fe-P-Zn alloy) in which Cu is added with Fe of 2.3 weight %, P of 0.03 weight % and Zn of 0.13 weight % is superior in conductivity, and is well known as a high strength copper alloy material for use in electrical and electronic parts which is superior in heat resistance (the official gazette of Japanese Patent Publication No. 52(1977)-20404).

The iron-contained copper alloy contains Fe over a solid solubility limit of Fe in Cu at a normal temperature. Accordingly, iron is contained as crystallized substances or precipitates in an ingot of the iron-contained copper alloy produced by a continuous casting or a semi-continuous casting.

Before the ingot of the conventional iron-contained copper alloy is hot worked, it is required to be homogenized by annealing at a temperature of 930°–1050° C. as a heat treatment before the hot working in order to make the crystallized or precipitated iron into solid solution.

Also, ingots of copper alloy such as the above mentioned iron-contained alloy and the like have a brittleness region in a range of 500°–700° C., and an high temperature elongation thereof in this temperature range is not greater than 6%. Further, if these copper alloys such as iron-contained copper alloy and the like contain S, S moves in a grain boundary to accelerate the brittleness.

Therefore, there is a problem that, if the ingot having residual stress not less than 10 kgf/mm$^2$ held at the brittleness temperature range over 30 minutes in a homogenizing annealing process, cracking is apt to occur, further cracking in a hot rolling process is apt to occur.

In order to prevent these disadvantages, the ingot is heated at a high temperature increasing rate. However, in case of the ingot which is large-sized to the degree of 150 mm in thickness, 550 mm in width, 5000 mm in length, and 4 ton in weight, for example, it is difficult to pass through the brittleness temperature range at a high temperature increasing rate.

On the other hand, although it is effective to add Sn in order to improve a strength and a molding workability of the above mentioned iron-contained copper alloy, there is caused a problem that the addition of Sn accelerates the brittleness more.

Further, recent years, since the resistors of the integrated circuit, etc. are increased in the number of the electrodes and are required to be packaged in high density into the printed-circuit board with the requirement of a weight-lightening and a miniaturization of the electrical and electronic parts, a pitch between the electrodes is decreased from 1/10 inch (2.54 mm) to 1/20 inch (1.27 mm) or 1/30 inch (0.847 mm), and accordingly, a pitch between the terminal and the connector becomes narrow.

In this way, the pitch between the electrodes of the electrical and electronic parts becomes narrow, so that there is apt to be caused disadvantages in which ions is eluted into a water fitted between the electrodes due to a dew condensation or an entering of the water, the ionized metal element moves to the negative pole to be separated thereon, metal crystals grow in a dendrite form from the negative pole similar to a plating (an electrical separating), then the metal crystals reach to the positive pole to cause the short circuit. This is referred as a migration phenomenon. In case of the copper alloy for use in the electrical and electronic parts, the migration phenomenon of Cu is apt to occur. There is a problem that when this phenomenon occurs, the electrodes short-circuit with each other.

Further, there are many cases that the copper alloy for use in the electrical and electronic parts is normally formed by press punching (stamping) a strip material. Accordingly, an improvement of the service life (wear resistance) of the used metal tool turns out to be required from the cost-wise viewpoint.

DISCLOSURE OF THE INVENTION

It is, therefore, an object of the invention to provide a copper alloy for use in electrical and electronic parts which can dissolve the drawbacks of the above mentioned Cu-Fe-P-Zn alloy, that is, the prior problems that cracking occurs on the ingot during heating on the hot working process or during hot working, and can prevent a short-circuit due to the migration phenomenon of copper which is apt to occur with the high density integration of the electrical and electronic parts made of copper alloy, and further can improve the tool service life (wear resistance) of the die and can decrease the producing cost thereof.

A copper alloy for use in an electrical and electronic parts according to the present invention consists essentially of Fe of 1.8–2.0 weight %, P of 0.025–0.040 weight %, Zn of 1.7–1.9 weight %, Sn of 0.40–1.0 weight %, and Ca of 0.0001–0.01 weight %, and the balance being Cu and inevitable impurities.

Also, one kind or two kinds of the elements selected from the group of Cr of 0.001–0.01 weight % and Mg of 0.001–0.01 weight % may be contained by 0.001–0.01 weight % at a total amount.

In the present invention, due to the addition of the specified alloy elements in to the copper alloy, Fe is controlled from the separation to the grain boundary on the ingot, the embrittlement of the boundary and the middle and high temperature brittleness are improved, and the formation of the migration of the electrical and electronic parts is controlled, and further the tool service life (wear resistance) of the die is improved. Particularly, the present invention is to add Sn in the copper alloy to improve the strength and the molding workability, and to compensate the decreasing of the hot workability due to the addition of Sn by removing a single substance S due to the addition of a very small amount of Ca, and further to improve the migration resistant characteristic and to decrease the wear amount of the die during punching (stamping) by adding Zn of a proper quantity.

The reason why respective addition elements are added and the reason why the composition is limited will be described hereinafter.

Fe: 1.8–2.0 Weight %

Fe precipitates as γ iron to thereby contribute to an improvement of the strength of a copper alloy, however, in a case where the content thereof is less than 1.8 weight %, the high strength to be aimed cannot be obtained. Also, in a case where Fe is contained in a molten copper alloy over 2.0 weight %, Fe is crystallized too many in an ingot, then even if the heat treatment is conducted to the copper alloy, the precipitates of Fe are difficult to be decreased. Further, since the crystallized substance of Fe is great in hardness, the wear resistance of the die decreases. Accordingly, Fe content is determined to be 1.8–2.0 weight %.

P: 0.025–0.040 Weight %

P is not enough in deoxidization effect in the molten metal in a case where the content thereof is less than 0.025 weight %. Alternatively, in a case where P content exceeds 0.040 weight %, eutectic Cu and $Cu_3P$ are produced, then causing the deterioration of the hot workability of the copper alloy. Accordingly, P content is required to be 0.025–0.040 weight %.

Zn: 1.7–1.9 Weight %

Zn is an element which is indispensable in order to prevent the formation of the migration of Cu to thereby decrease the leak current in a case where a water enters or a due condensation occurs between the poles of the electrical and electronic parts applied with a voltage. Also, the addition of Zn contributes to an extension of the tool service life of the die.

The migration restricting effect is small in a case where Zn content is less than 1.7 weight %, and the conductivity is decreased and the stress corrosion cracking is apt to occur in a case where Zn content exceeds 1.9 weight %. Further, even if Zn is added over 1.9 weight %, the effect that the tool service life is elongated cannot be obtained. Accordingly, Zn content is determined to be 1.7–1.9 weight %.

Sn: 0.40–1.0 Weight %

Sn solid solutes in the copper alloy and has an effect of improving the strength and the molding workability. But, the effect is small in a case where the addition amount of Sn is less than 0.40 weight %, and the decreasing of the conductivity is caused if Sn content exceeds 1.0 weight %. Accordingly, Sn content is determined to be 0.40–1.0 weight %.

Ca: 0.0001–0.01 Weight %

Ca is an element which is the lowest in a free energy of forming hydrosulufide. Accordingly, Ca is the element for floating up and separating S in the molten copper alloy as a stable compound (CaS) with Ca. The element S is mixed from the raw material, the internal isolation and the atmosphere into the molten copper alloy. Also, the residual S is fixed by Mg in the base phase as MgS to remove it, thereby improving the hot workability. However, the effect due to the above mentioned addition of Ca is less in a case where Ca content is less than 0.0001 weight %. On the other hand, S moves in the grain boundary to accelerate the grain boundary cracking in a case where Mg content is less than 0.01 weight %. On the other hand, the producing cost becomes expensive to be disadvantageous in a case where Ca content exceeds 0.01 weight %. Accordingly, Ca content is determined to be 0.0001–0.01 weight %. Moreover, Ca first generates a compound with oxygen, and does not form a compound with S in a case where there is oxygen. Accordingly, it is required to remove oxygen previously by the addition of the cheap compound of Mg and P and the like before the addition of Ca.

Cr, Mg

Cr and Mg are elements for improving the hot workability by the addition thereof together with Ca. In more detail, Cr is an element for strengthening the grain boundary in the ingot, and Mg is an element for fixing S in the base phase as a stable compound (MgS) with Mg to improve the hot workability. The effect of Mg is similar to Ca.

Accordingly, as required, at least one kind of Ca of 0.001–0.01 weight % and Mg of 0.001–0.01 weight % is contained by 0.001–0.01 weight % as a total amount.

Cr and Mg each has not enough effect of preventing the hot cracking in a case where the addition amount thereof is less than 0.001 weight %. Also, if Cr and Mg is contained over 0.01 weight % individually or in total amount, the molten metal is apt to be oxidized, so that the sound ingot cannot be obtained, then there is caused an decreasing of the conductivity.

Accordingly, it is determined that the contents of Cr and Mg each is 0.001–0.01 weight %, and the total amount thereof is 0.001–0.01 weight %.

According to the present invention, there can be obtained the economical copper alloy for use in the electrical and electronic parts in which the brittleness at the middle and high temperature is improved, the hot rolling can be realized, the mechanical characteristic and the molding workability are superior, and the migration phenomenon of Cu is prevented, the short circuit between the electrodes is eliminated, and further, since the tool wear resistance is superior, the service life of the die is extended to thereby decrease the cost for the die changing.

BEST FORM FOR EXECUTING THE PRESENT INVENTION

Figure 1:
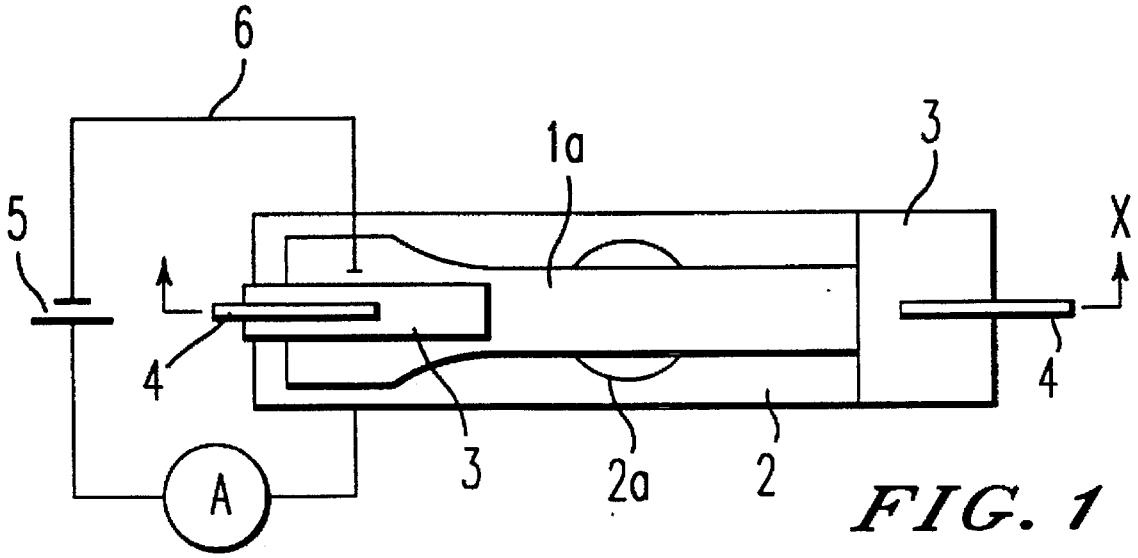
FIG. 1 is a plan view of an experimental apparatus for measuring the maximum leak current.

The copper alloy for use in the electrical and electronic parts according to examples of the present invention will be described hereinafter while comparing the characteristic thereof with that of the alloy of the comparative examples. First, the copper alloy with a composition shown in following Table 1 is melted in the atmosphere by an electrical furnace in a condition that the copper is coated with charcoal, thereby the ingot which is 150 mm in thickness, 550 mm in width and 5000 mm in length is produced.

TABLE 1

| | Chemical composition (weight %) | | | | | | | |
|---|---|---|---|---|---|---|---|---|
| No | Fe | P | Zn | Sn | Ca | Cr | Mg | Cu |
| Example | | | | | | | | |
| 1 | 1.99 | 0.039 | 1.82 | 0.50 | 0.004 | — | — | balance |
| 2 | 1.91 | 0.033 | 1.71 | 0.42 | 0.006 | — | 0.005 | " |
| 3 | 1.83 | 0.039 | 1.71 | 0.90 | 0.005 | 0.006 | — | " |
| 4 | 1.99 | 0.030 | 1.89 | 0.41 | 0.004 | — | 0.006 | " |
| 5 | 1.94 | 0.028 | 1.88 | 0.90 | 0.009 | 0.006 | — | " |
| 6 | 1.90 | 0.034 | 0.80 | 0.41 | 0.005 | 0.005 | 0.005 | " |

TABLE 1-continued

| No | Chemical composition (weight %) | | | | | | | |
|---|---|---|---|---|---|---|---|---|
| | Fe | P | Zn | Sn | Ca | Cr | Mg | Cu |
| Comparative Example | | | | | | | | |
| 7 | 1.92 | 0.034 | 1.89 | 0.51 | — | — | — | " |
| 8 | 1.91 | 0.038 | 0.71 | 0.43 | — | 0.005 | — | " |
| 9 | 1.89 | 0.029 | 1.80 | 0.44 | — | — | 0.005 | " |
| 10 | 1.86 | 0.035 | 1.72 | 0.07 | 0.006 | 0.055 | 0.005 | " |
| 11 | 1.90 | 0.005 | 1.88 | 0.51 | 0.001 | 0.002 | 0.004 | " |
| 12 | 1.95 | 0.060 | 1.76 | 0.68 | 0.009 | 0.004 | 0.006 | " |
| 13 | 1.93 | 0.033 | 0.50 | 0.33 | 0.005 | — | 0.006 | " |
| 14 | 1.90 | 0.038 | 5.31 | 0.40 | 0.006 | 0.004 | 0.004 | " |
| 15 | 1.90 | 0.033 | 1.88 | 0.10 | 0.004 | — | 0.005 | " |
| 16 | 1.92 | 0.034 | 1.77 | 2.11 | 0.005 | 0.004 | 0.005 | " |

Respective ingots produced in this way are cut to make hot rolling test pieces, each of which is 40 mm in thickens, 180 mm in width and 250 mm in length. The hot rolling test pieces are hot rolled by three times passings with the hot rolling condition in which the start temperature is 950° C. and a rolling ratio every one passing is about 25%. The temperatures of hot rolling test pieces at the finishing of hot rolling are not lower than 650° C. and the thickness of the test pieces are 15 mm.

Further, test pieces for evaluating the middle and high temperature brittleness, each of which is 5 mm in thickness, 20 mm in width and 150 mm in length, are made from the above mentioned ingot. In the test for evaluating the middle and high temperature brittleness, the test piece is loaded with an stress of 10 kgf/mm$^2$ in a three point support bending to be held at 600° C. for one hour, and then after cooling, the test piece is bent at 90° in an inward bending radius 30 mm at the normal temperature, so that the presence of the cracking is checked.

Also, for the test of the mechanical characteristic and the migration resistance, each one portion of respective ingots is heated at 950° C. for one hour, after that, the hot rolling is executed to be made a plate of 15 mm in thickness, then the plate is quenched in the water.

A scale on the surface of the above mentioned hot rolling material is removed by the grinder, after that, the cold rolling is executed to make a plate of 0.5 mm in thickness, then two-stage annealing in which the plate is heated at 575° C. for two hours, further heated at 450° C. for four hours is conducted to precipitate. Next, the cold rolling is executed to make a rolled material of 0.25 mm in thickness, then the final annealing of 400° C. for removing strain is executed to be a specimen, from which various test pieces such as JIS NO. 5 tensile test piece and a migration resistance test piece (3 mm in width, 80 mm in length) and the like are made.

Figure 2:
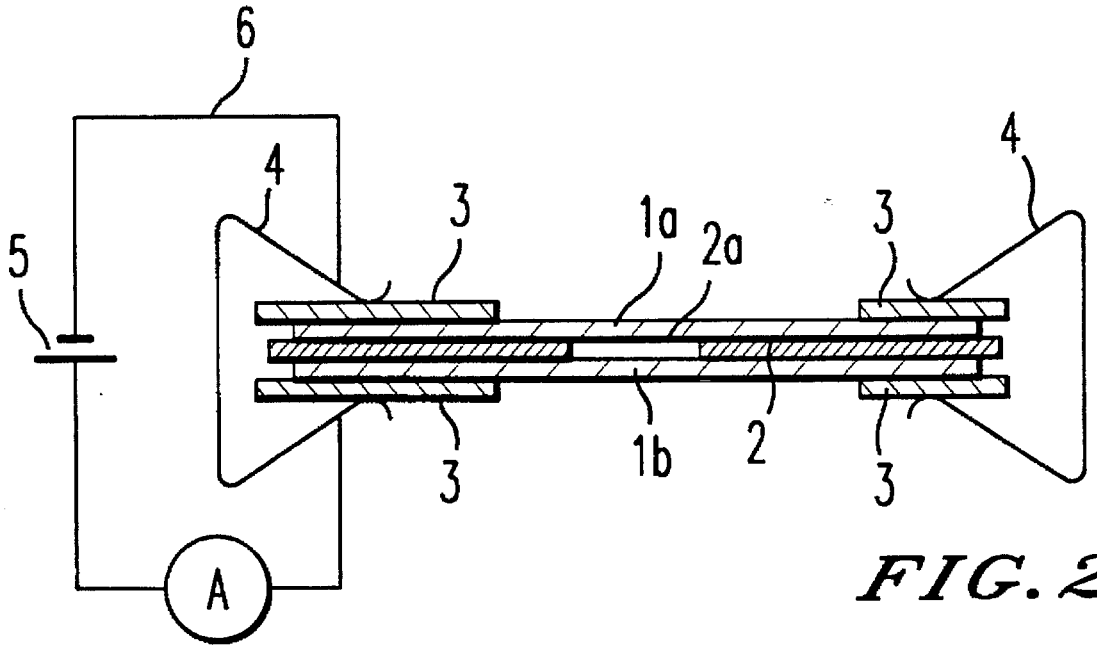
FIG. 2 is a plan view of the experimental apparatus for measuring the maximum leak current.

FIGS. 1 and 2 show a test apparatus for use in a migration resistance test (for use in a measurement of a leak current) using the above mentioned pest piece. In FIGS. 1 and 2, references 1*a*, 1*b* denote a test piece, 2 is a ABS resin which is 1 mm in thickness, 3 is a pressing plate of the ABS resin 2, 4 is a clip made of vinyl chloride for pressing and fixing the pressing plate 3, 5 is a battery, and 6 is an electrical wire. The test pieces 1*a*, 1*b* are connected with the electrical wire 6 at end portions thereof.

Two of the test pieces 1*a*, 1*b* shown in FIGS. 1 and 2 are applied with a direct voltage 14 V from the battery 5, and submerged in the city water for five minutes. And then, the test pieces are dried for 10 minutes. These dry tests are conducted 50 times, during which the maximum leak current is measured by the high sensitivity recorder (not shown).

Figures 3A, 3B:
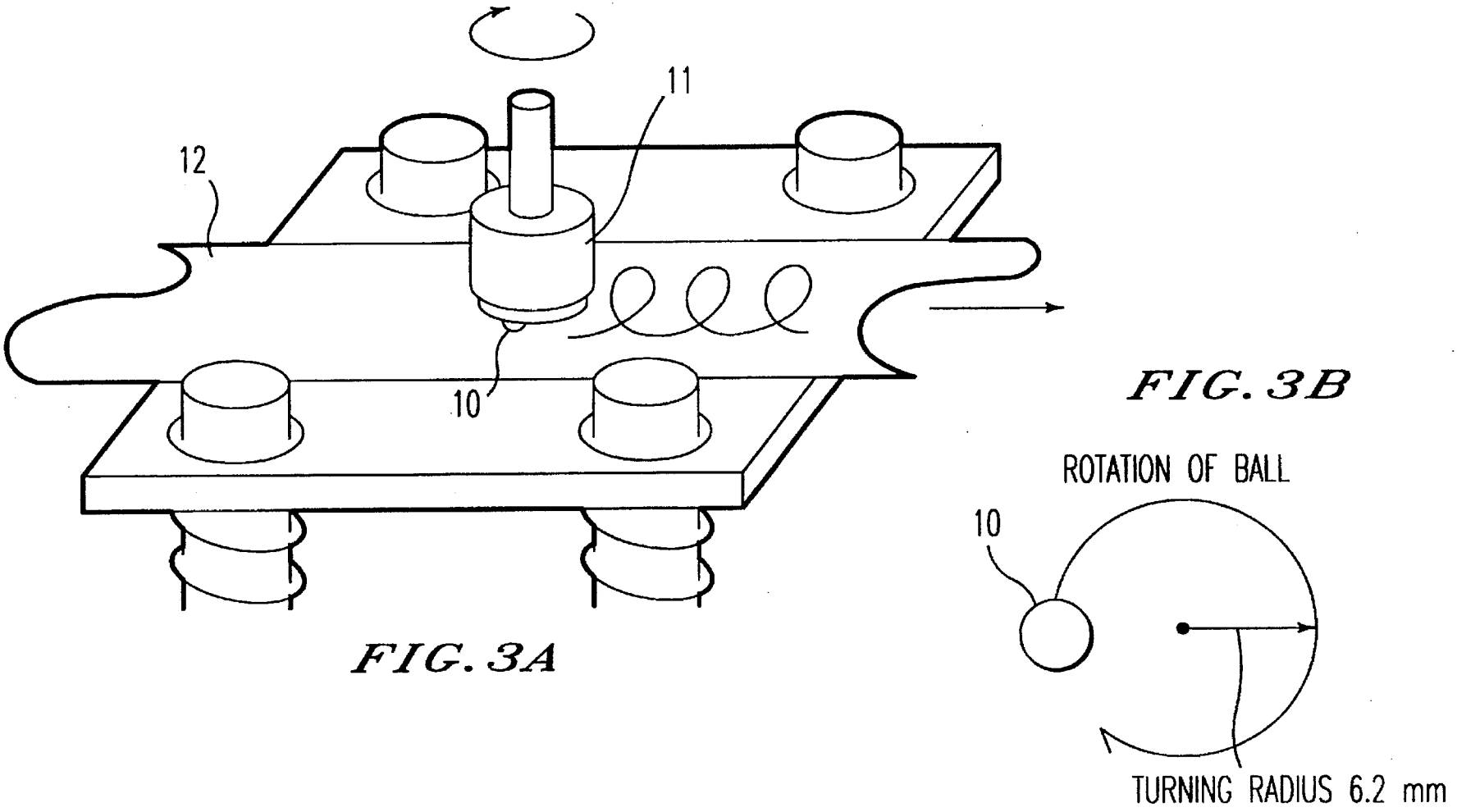
FIGS. 3(*a*) and 3(*b*) are schematic views of a tool wear resistance test apparatus.
Figure 4A:
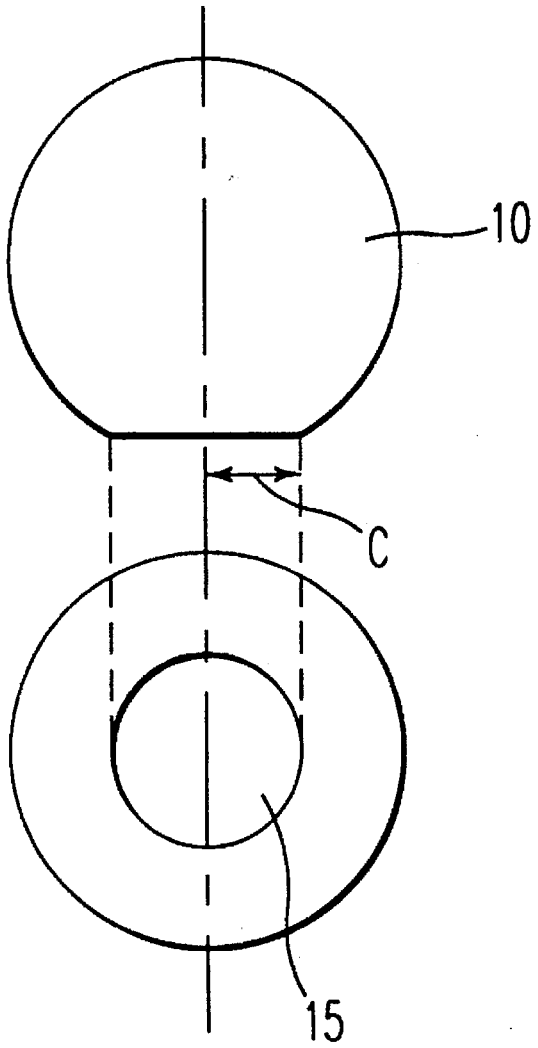
FIG. 4(*a*) shows a radius of the worn surface, and FIG. 4(*b*) shows the height of the worn surface.
Figure 4B:
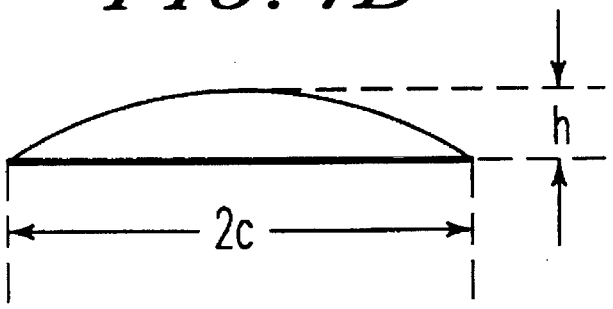

Also, the tool service life (wear resistance) of the die is evaluated by the apparatus shown in FIG. 3. That is, the ball 10 on the markets attached onto the ball holder 11, the ball 10 is pressed to the specimen 12 of the strip of copper alloy, after that, the ball holder 11 is rotated, so that the specimen 12 is advanced at a constant speed in an arrow direction shown in FIGS. 3(*a*) and 3(*b*), then a wearing amount of the ball 10 is calculated by a method shown in FIGS. 4(*a*) and 4(*b* ). So, the tool service life (wear resistance) of the die is evaluated. And, as shown in FIG. 4(*a*), a radius of the worn surface 15 of the ball 10 is referred as c. And, as shown in FIG. 4(*b*), if the height of the worn surface is referred as h, the height h is represented in the following equation (1).

$$h=r-(r^2-c^2)^{1/2} \quad (1)$$

In this case, reference symbol r denotes a radius of a sphere. And, a volume v of the worn portion shown in FIG. 4(*b*) is represented in the following equation (2).

$$v=\pi h^2 (r-h/3) \quad (2)$$

The volume v of the worn portion is obtained by the equations (1) and (2), the volume v is multiplied by a specific gravity (7.9) of the sphere to obtain the weight of the worn portion of the sphere, then this obtained value is made the worn amount.

Otherwise various test explained above, the tensile strength, the elongation, the hardness and the conductivity are measured also. The tensile strength and the elongation are tested by using JIS NO. 5 test piece in which the specimen is cut in parallel with the rolling direction. The hardness is measured at a load of 500 g by using Vickers hardness tester.

With respect to the test piece (10 mm in width, 300 mm in length) in which the specimen is cut in parallel with the rolling direction according to JIS H0505, the electric resistance thereof is measured by double bridge, then the conductivity is calculated by an average section area method.

These test results are shown in the following Tables 2 and 3.

TABLE 2

| No | Hot rolling test at 950° C. | Stress apply test at 600° C. Stress: 10 kgf/mm$^2$ | S content ppm |
|---|---|---|---|
| Example | | | |
| 1 | No edge cracking, No surface cracking | No cracking at all | 13 |
| 2 | " | " | 10 |
| 3 | " | " | 11 |

TABLE 2-continued

| No | Hot rolling test at 950° C. | Stress apply test at 600° C. Stress: 10 kgf/mm$^2$ | S content ppm |
|---|---|---|---|
| 4 | " | " | 11 |
| 5 | " | " | 7 |
| 6 | " | " | 6 |
| Comparative Example | | | |
| 7 | Edge cracking, surface cracking at one pass | Penetrating cracking | 38 |
| 8 | Edge cracking, surface cracking at two pass | Penetrating cracking | 35 |
| 9 | " | " | 26 |
| 10 | Sound ingot cannot be obtained | — | 11 |
| 11 | " | — | 15 |
| 12 | Edge cracking, surface cracking at one pass | Penetrating cracking | 10 |
| 13 | No edge cracking, no surface cracking | No cracking at all | 13 |
| 14 | " | " | 7 |
| 15 | " | " | 14 |
| 16 | " | " | 8 |

20

TABLE 3

| No | Mechanical characteristics Tensile Strength (N/mm$^2$) | Elongation (%) | Hardness (Hv) | Conductivity % IACS | Migration Characteristics Maximum leak current (g) | Wear resistance Wearing Weight (g) | Remarks |
|---|---|---|---|---|---|---|---|
| Example | | | | | | | |
| 1 | 513 | 13 | 161 | 53 | 0.45 | $2.1 \times 10^{-7}$ | — |
| 2 | 511 | 13 | 160 | 54 | 0.49 | $2.2 \times 10^{-7}$ | — |
| 3 | 530 | 14 | 168 | 44 | 0.50 | $2.3 \times 10^{-7}$ | — |
| 4 | 520 | 13 | 164 | 52 | 0.43 | $2.3 \times 10^{-7}$ | — |
| 5 | 535 | 14 | 170 | 43 | 0.44 | $2.2 \times 10^{-7}$ | — |
| 6 | 510 | 13 | 161 | 51 | 0.45 | $2.2 \times 10^{-7}$ | — |
| Comparative Example | | | | | | | |
| 7 | — | — | — | — | — | — | Cracking |
| 8 | — | — | — | — | — | — | " |
| 9 | — | — | — | — | — | — | " |
| 10 | — | — | — | — | — | — | " |
| 11 | — | — | — | — | — | — | " |
| 12 | — | — | — | — | — | — | " |
| 13 | 530 | 11 | 158 | 53 | 1.22 | $5.8 \times 10^{-7}$ | " |
| 14 | 547 | 13 | 160 | 36 | 0.40 | $2.0 \times 10^{-7}$ | " |
| 15 | 515 | 8 | 144 | 55 | 0.46 | $2.3 \times 10^{-7}$ | " |
| 16 | 611 | 12 | 178 | 32 | 0.47 | $2.3 \times 10^{-7}$ | " |

Table 2 shows results of the hot rolling test and the stress-load test. With respect to both tests, the material which is excellent in the result of the hot working test is excellent in the result of the stress-load test, and the material which is cracked at the hot rolling test is caused a cracking at the stress-load test. According to this, both tests correlates to each other.

As apparent from the result of Table 2, in the alloys No. 1 to No. 6 in this embodiment, even if the test piece is held one hour in a state that the stress of 10 kgf/mm$^2$ is applied, and at 600° C. at which temperature the test piece is liable to embrittle extremely on the way of temperature increasing during heating, there are not caused cracking at all. Also, no cracking occurs at the hot rolling test from 950° C. Also, as shown in Table 3, the alloys No. 1 to No. 6 in this embodiment, the test pieces are superior in mechanical strength in which the tensile strength is not less than 510 N/mm$^2$, the elongation is not less than 13% and the hardness is not less than HV160, and the test piece has the conductivity of not less than 43% IACS.

Also, the migration resistance characteristic is superior, since the alloys No. 1 to No. 6 in this embodiment is low in maximum leak current to be not greater than 0.50 A. The tool service life (wear resistance) of the die can be expected to be improved, since the worn amount of the ball is low to be not greater than $2.3 \times 10^{-7}$ g.

That is, the alloy according to the present invention contains Ca of 0.0001–0.01 weight %, and is decreased in the single substance S to improve the hot workability. Further, the alloy according to the present invention contains one kind or two kinds of the elements selected from the group of Cr of 0.001–0.01 weight % and Mg of 0.001–0.01, by 0.001–0.01 weight % at a total amount, so that the hot workability is improved further. Also, the alloy according to the present invention contains Sn of 0.40–1.0 weight % to improve the mechanical characteristic, and contains Zn of 1.7–1.9 weight % to improve the migration resistant characteristic and the tool service life (wear resistant) of the die.

To the alloy of the embodiment according to the present invention, in the alloys No. 7 to No. 9 of the comparative example, as shown in Table 2, edge cracking and surface cracking occur at the hot rolling test from 950° C. The alloy No. 7 of the comparative example is broken by the twice passings of the rolling, the alloys No. 8 and No. 9 of the comparative example are broken by the triple passings of the rolling. Also, in these test pieces, there are caused penetrating cracking on the stress-load test at 600° C.

In the alloys No. 10 to No. 11 of the comparative example, the sound ingot cannot be obtained, the subsequent tests are interrupted.

In the alloy No. 12 of the comparative example, the edge cracking and the surface cracking occur at the hot rolling test. In the alloy No. 12 of the comparative example is broken by the twice passings of the rolling. There is caused a penetrating cracking on the stress-load test. Moreover, in the alloy No. 13 of the comparative example, as shown in Table 3, the maximum leak current is high to be 1.22 A, so that the migration resistance characteristic is inferior, and the wore amount of the tool is great to be $5.8\times10^{-7}$ g, so that the tool service life (wear resistance) of the die is inferior.

Further, the alloy No. 14 of the comparative example is inferior in conductivity, and the alloy No. 15 is inferior in mechanical characteristic.

The alloy No. 16 of the comparative example is superior in mechanical characteristic, but is low in conductivity.

That is, in the alloys No. 7 to No. 10 of the comparative example, since the Ca, Cr and Mg contents are deviated from the range specified by claims according to the present invention, the cracking occur at the time of the hot working. Further, in the alloys No. 7 to No. 9 of the comparative examples, since Ca is not added, the S content is increased, so that the crackings occur at the hot working. In the alloy No. 10 of the comparative example, since the Cr content is deviated from the range specified by claims according to the invention, the surface of the ingot becomes rough and the sound ingot cannot be obtained. Also, in the alloy No. 11 of the comparative example, since the P content is deviated from the range specified by claims according to the invention, the deoxidization effect is not enough and the sound ingot cannot be obtained.

In the alloy No. 12 of the comparative example, since the P content exceeds the range specified by claims according to the invention, the decreasing of the hot workability is caused.

In the alloy No. 13 of the comparative example, since the Zn content is less than the range specified by claims according to the invention, the migration resistance characteristic and the tool service (wear resistance) of the tool is inferior.

In the alloy No. 14 of the comparative example, since the Zn content exceeds the range specified by claims according to the invention, the conductivity is inferior.

In the alloy No. 15 of the comparative example, since the Sn content is less than the range specified by claims according to the invention, the mechanical characteristic is inferior, and in the alloy No. 16 of the comparative example, Sn content exceeds the upper limit specified by claims according to the invention, the conductivity is low.

What is claimed is:

1. A copper alloy consisting essentially of Fe of 1.8–2.0 weight %, P of 0.025–0.040 weight %, Zn of 1.7–1.9 weight %, Sn of 0.40–1.0 weight %, Ca of 0.0001–0.01 weight %, Cr of 0.001–0.01 weight %, and S of 13-6 ppm, and the balance being Cu and inevitable impurities, wherein said copper alloy has a tensile strength of not less than 510 N/mm$^2$, an elongation of not less than 13%, a hardness of not less than HV160, and a conductivity of not less than 43% IACS.

2. The copper alloy of claim 1, wherein said alloy comprises P of 0.028–0.039 weight %.

* * * * *